United States Patent [19]

Kaderjak et al.

[11] 4,436,954

[45] Mar. 13, 1984

[54] STEEL-CORED ALUMINUM CABLE

[76] Inventors: Gyula Kaderjak, Bathory I.u.26/a, 3532 Miskolc, III; Albert Veres, Selyemret u.2.II.1, 3527 Miskolc; Istvan Barkoczy, Kommün u.2., 3530 Miskolc; Janos Lonscsak, Barathegyalja u.54., 3532 Miskolc, III, all of Hungary

[21] Appl. No.: 289,191

[22] Filed: Aug. 3, 1981

Related U.S. Application Data

[63] Continuation of Ser. No. 135,514, Mar. 31, 1980, abandoned, which is a continuation of Ser. No. 934,588, Aug. 17, 1978, abandoned.

[30] Foreign Application Priority Data

Aug. 19, 1977 [HU] Hungary ..... DE 939

[51] Int. Cl.[3] ..... H01B 5/10

[52] U.S. Cl. ..... 174/128 R; 29/728; 29/745; 29/828; 29/872; 174/126 R; 174/129 R

[58] Field of Search ..... 174/128, 126 R, 108, 174/40, 23 C; 29/728, 745, 828, 868, 871, 872

[56] References Cited

U.S. PATENT DOCUMENTS

| | | | |
|---|---|---|---|
| 2,001,319 | 5/1935 | Stanley | 174/128 R |
| 3,444,610 | 5/1969 | Thomson | 174/126 X |
| 3,445,586 | 5/1969 | Edwards et al. | 174/42 X |
| 3,813,481 | 5/1974 | Adams | 174/130 |
| 3,813,772 | 6/1974 | Adams | 29/624 |
| 3,875,323 | 4/1975 | Bopp et al. | 174/23 C |

*Primary Examiner*—R. R. Kucia

*Attorney, Agent, or Firm*—Gabriel P. Katona

[57] ABSTRACT

A steel-cored aluminum cable for electric power conduction comprises a steel core including a plurality of steel wires and an aluminum coating disposed therearound in direct contact therewith and formed from an aluminum sheet and a plurality of aluminum staples disposed around the aluminum coating in direct contact with the aluminum coating along the entire innermost circumferential surface of the aluminum staples.

10 Claims, 2 Drawing Figures

STEEL-CORED ALUMINUM CABLE

Figure 1:
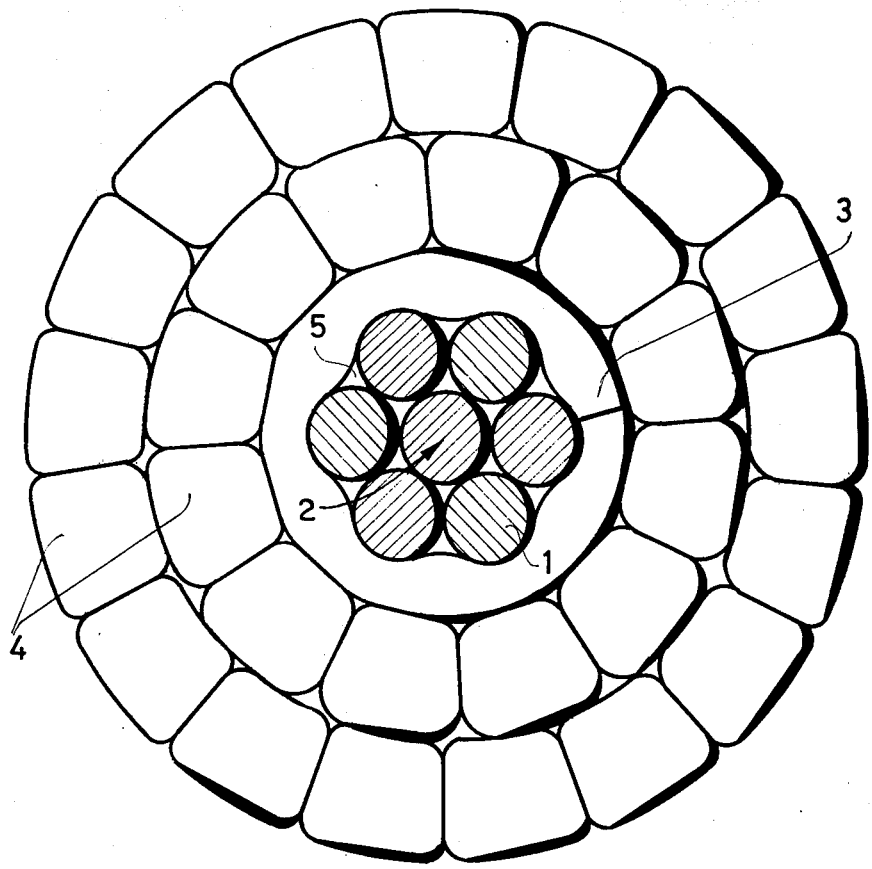

This is a continuation of Ser. No. 135,514 filed on Mar. 31, 1980 which is a continuation of Ser. No. 934,588 filed Aug. 17, 1978 both now abandoned.

The subject matter of the invention is a steel-cored aluminium cable used mainly for electric power conduction in which the steel core itself is a cable and the aluminium mantle around it consists generally of cable-like staples.

One of the claims made against the steel-cored aluminium cables of power transmission lines serving for electric power conduction consists in that they should be satisfactory in respect to the mechanical strength. As it is known the mechanical load shall be taken by the steel core. It follows from the operative conditions of the steel-cored aluminium cables used nearly exclusively as everhead lines that the mechanical stress of the steel core is highly complex. It is simultaneously loaded for tension, bending and torsion. The load-up condition of the steel core is rendered more serious by the fact that the direction and extent of bending and those of torsion are varying in time due to the oscillation of the overhead line.

Another requirement made against the steel-cored aluminium cables is that they should cause the less possible loss from electrical point of view. It is well known that this loss taken from electrical point of view which in case of the investigated steel-cored aluminium cables can be influenced by their construction or dimension, is the sum of the ohmic resistance of the parts participating in the conduction, of the reactance of the steel-cored aluminium cable and of the loss occurring due to the varying reverse magnetization of steel core.

A third requirement is that the specific weight of the steel-cored aluminium cable shall be as low as possible. Under specific weight generally the weight of 1 km long cable is understood.

The following requirement relates to the life. The conditions reducing the life of overhead lines can be divided into two groups. One of the groups comprises the mechanical requirements, whereas with the second group the effects of chemical nature can be ranged. From among the mechanical reasons of the loss of life, the abrasion occurring at the displacement on each other and relative to each other of wires being in the steel-cored aluminium cable construction, the wearing effect caused by the solid contaminations originating from the air, further the fatigue caused by the alternate stress, related to the mechanical strength, are worth mentioning. The detrimental effects of chemical nature can be designated by the corrosion as generic term. As it is known, the corrosion of overhead lines can be traced back to the various contaminations of the ambient atmosphere. In the gaps of the overhead lines aggressive liquids—various acids—originate due to the presence of contaminations and water, which then eat away the material of the wire. The corrosion constitutes a danger primarily for the steel core, the surface oxide layer of aluminium namely sufficiently resists these aggressive liquids, whereas the steel does not do so. The corrosion—and the corrosion prevention—have a special significance in case of overhead lines arranged near the sea.

A further requirement consists in that the space utilization factor of the steel-cored aluminium cable should be as advantageous as possible. Under the space utilization factor the ratio of the sum of the steel wires and aluminium wires in the cross-section of the steel-cored aluminium cable as well as of the surface reckoned in the nominal diameter of the wire is to be understood.

As a matter of fact a highly decisive requirement is that the steel-cored aluminium cable should be inexpensive. With respect to the price of aluminium cables the costs of the production process and the price of the used material are of decisive significance.

Several requirements and aspects are still to be found with the steel-cored aluminium cables, they are, however, not deemed significant with respect to the invention so as to deal with them in the description of the invention.

From among the known constructions of steel-cored aluminium cables serving for the electric power conduction, the following construction is primarily used. The steel core is made of a steel cable stranded of zinc-plated steel wires. Around this steel core the aluminium mantle is arranged consisting of aluminium wires or of staples made of aluminium wires. The stranding direction of the steel core and that of aluminium wires, and staples, respectively, are opposite. The individual aluminium wires contact each other and the steel wires of the steel core only loosely, thus, the aluminium wires, and staples, respectively, have practically circular cross-section. The steel-cored aluminium cables of the above described construction are produced in such a way that the steel wire is provided with a zinc layer, of the zinc-plated steel wires steel cable is made and thereon the mantle consisting of aluminium wires, and staples, respectively, are stranded with a stranding direction opposite to that of the steel cable.

One of the drawbacks of the steel-cored aluminium cable of such known construction, with respect to the mechanical strength, consists in that for taking up a definite load, a relatively large steel cross-section shall be chosen. The relatively large steel cross-section is necessary since as material of the steel wires constituting the steel cable, steel of maximum tensile strength of 100–120 kp/sq.mm but not steel of higher tensile strength can be used. As it was already referred to with the production process of known steel-cored aluminium cable, in the course of this known process the steel wire is zinc-plated, and in order to provide for a zinc layer of suitable thickness, the so-called hot-dip galvanizing process shall be used. At the temperature of the hot-dip galvanizing the steel materials of higher tensile strength undergo a metallographic transformation reducing the original tensile strength.

Due to the relatively large steel cross-section the component of the power loss, caused by the hysteresis loss of the steel core, relatively increases.

The specific weight of the known steel-cored aluminium cables is also relatively great just because the cross-section of the steel core is rather large in order to provide for the above discussed mechanical strength. In the specific weight of the total steel-cored aluminium cable, the steel core makes out namely a considerable part since the specific weight of the material of steel core is round three times as great as the specific weight of the aluminium mantle.

The steel-cored aluminium cable of known construction is disadvantageous also with respect to the space utilization factor. In case of the given construction namely the aluminium wires, and the staples consisting of such wires, respectively, forming the aluminium mantle cannot be caulked onto the steel core, since the contacting parts of the oppositely stranded steel-core and aluminium staple bear up against each other only on a small surface, therefore a great compressive force would occur at the contacting surfaces. In case of this great compressive force, the relative motions indispensable in the course of the oscillation of the cable under operating conditions would cause a high abrasive effect and a reduction in size a detrimental with respect to the conduction in the aluminium wires.

The steel-cored aluminium cable has considerable drawbacks even as regards the life. From among the mechanical effects reducing the life, the already mentioned abrasive effect displays itself primarily. The cable of loose construction—having a poor space utilization factor—does not preclude that the solid grains being present always in the environment of the overhead line—e.g. dust—penetrate in between the steel wires of the steel core. These very hard grains exert a coarse abrasive effect in the course of the oscillation of the overhead line during the displacement of steel wires as compared to each other. The most decisive effect with respect to the reduction of life is displayed by the corrosion. In case of steel-cored aluminium cable of loose construction, the humidity in the environment of the overhead line and the gases and vapours always present in the atmosphere can unimpeded penetrate in between the steel wires of the steel core and under the effect of the electric voltage or due to a simple solution process, highly aggressive nitric acid, sulfuric acid or other deleterious material originates which destroys the material of the steel core within a short time to such an extent that it becomes unsuitable for carrying the mechanical load. The corrosion process destructs especially quickly the steel part of the steel-cored aluminium cable being in the vicinity of the sea. The steel-cored aluminium cables of such known construction of the power transmission lines built in the neighborhood of the seaboard must be replaced mainly every fifth-seventh year preventing thus the breaking off of the overhead line.

Severe economic drawbacks connected to the above enumerated detrimental properties of the steel-cored aluminium cable of known construction also occur. Instead of their analysis, reference is made only to the expensiveness of the production process by drawing the attention to the additional charges arisen due to the zinc plating operation. The zinc plating operation makes out namely a considerable part of the total production cost-referred to a predetermined length of the steel-cored aluminium cable.

In order to eliminate the drawbacks of the steel-cored aluminium cables of known construction various efforts were made. A solution became known in which the steel wires of the steel core are led through an aluminium bath before their stranding and in this way an aluminium coating is formed on the steel wire. The steel wires provided with aluminium coating are then stranded and to the cable produced in this way an aluminium mantle is applied. Description of the above mentioned coating with aluminium of steel wires is to be found in the U.S. Pat. No. 3,779,056, whereas the steel-cored aluminium cable in case of which the steel core is stranded of aluminium-coated wires is called alumoweld.

The production costs of alumoweld cables are high, since a wearisome technology and highly intricate equipment are required for coating with aluminium layer the steel wires. In addition to the high production costs, the overhead lines made of alumoweld cables have several drawbacks in the operation, too. First of all, it must be pointed out that the connection between the aluminium and the steel wire is ensured only by a slight adhesive force, therefore just during the production of the steel core the steel wires become denuded in some points. Cracks of the aluminium coating on the steel wires shall be also taken into consideration, due to the temperature changes as well as to the varying mechanical stresses. The corrosion of the steel surfaces denuded for the above reasons is unimpeded, therefore the steel wires will be destructed very soon to such an extend which renders necessary the replacement of the steel-cored aluminium cable. For such reasons—that is the high production costs and the notwithstanding short life—the alumoweld cables have not become current in the practice.

Such solutions are also known in which the steel wires of the steel core are coating with aluminium layer before stranding by means of a galvanoplastic process. This process is similarly very expensive and mainly the same drawbacks occur as with the above mentioned alumoweld cables. Therefore, the steel-cored aluminium cables made by this process could not gain ground either.

The U.S. Pat. No. 3,813,772 introduces a solution in which from aluminium sheet or sheets a single-layer or multi-layer tube is made and the steel wire bundle or the steel cable prepared in advance is pulled into this tube. This print referred to contains also much a variation, in case of which a tube is developed by bending one beside the other several aluminium bands. Such a solution is also recognizable in which drawn tube is made, further such one in which a tube is bent of a sheet welded together longitudinally. With all these solutions according to this American patent the steel cable is arranged loosely in the aluminium tube developed in whatever way. The use as power transmission line of this cable made by such process did not hitherto occur at all, since the production costs are extremely high and the process is highly complicated, on the one hand, and since the assembly necessary with the power transmission lines of such a loose construction is nearly insoluble, further in the course of the oscillation of overhead lines the steel cable loosely arranged within the aluminium tube would destroy in a short time the wall of the aluminium tube, on the other hand. In addition, the aggressive medium could not be prevented to penetrate into the inner space of the aluminium tube from the atmosphere, and to originate e.g. in case of precipitations caused by the changes of temperature, respectively. Due to these conditions, this solution would not at all reduce the risk of corrosion.

The U.S. Pat. No. 3,874,076 should be also mentioned, according to which the insulated wire for electric power line can be provided with metal coating in such a manner that around the insulated wire metal plate is bent by means of a tool and then, the insulated wire coated in this way, being pulled through a drawing stone, will undergo a considerable reduction in area. This process is similarly extremely expensive, moreover, it is not suitable for producing steel core for the steel-cored aluminium cables from these wires. The insulation is namely completely needless in case of overhead lines, moreover, e.g. due to its effect increasing the specific weight it is expressly determinal. Therefore, the solution to be learnt from the U.S. Pat. No. 3,874,076 is used exclusively for metal coating of insulated wires but cannot be widely popular with steel-cored aluminium cables.

The provision with aluminium mantle of cable-like line consisting of insulated wires is introduced by the U.S. Pat. No. 3,766,745. With this solution the bundle consisting of insulated wires is provided with insulated coating and the aluminium sheet is bent around the coating; the ends of the sheet sonstitute radially extending strips. These sheet strips welded together and extending radially side by side are bent onto the aluminium mantle—i.e. laterally with respect to the strips. The cable provided with metal mantle in this way is then coated by a plastic or other insulating layer. This process cannot be applied in case of steel-cored aluminium cables since the laterally bent sheet strips would constitute such sections of attack for the aluminium mantle arranged around the aluminium coating which would very soon wear the aluminium wires touching it and the mantle itself would be destroyed in a short time.

By means of the steel-cored aluminium cable according to the invention the drawbacks of the known solutions can be nearly completely eliminated. The process being subject matter of the invention renders possible the bulk production of the suggested steel-cored aluminium cables by an economic technology suitably in every respect.

The aim set to the steel-cored aluminium cable according to the invention has been to provide for a construction fully satisfactory also with respect to the mechanical strength, with a smaller cross-section, in addition, to reduce the electrical losses as much as possible and, as a special aim was set to achieve a longer life of the steel-cored aluminium cable than that of the widerly used steel-cored aluminium cables.

The steel-cored aluminium cable according to the invention achieves the set aim by that it contains a coating made of aluminium sheet around the steel core. This aluminium coating is pressed to a slight extent in between the steel wires of the steel core when the coating of aluminium sheet is formed onto the steel wires constituting the steel core and thus, the aluminium coating forms with the steel core a rigid unit advantageous with respect to the assembly of the overhead lines. Around the steel core provided with aluminium coating a mantle consisting of aluminium wires or of staples developed from such wires is arranged. Since, however, the aluminium mantle does not bear up against the steel wires of the steel core but against the coating to be considered essentially an aluminium tube arranged around the steel core, the aluminium mantle can be upsetted to the steel core to a much greater extent than with the earlier solutions. Due to this fact the space utilization factor of the steel-cored aluminium cable according to the invention is much more advantageous than that of the known steel-cored aluminium cables.

When taking into consideration that with the steel-cored aluminium cable according to the invention the steel wires of the steel core shall not be zinc-plated, it is obvious that steels of higher strength can be easily used for the steel core. Wires made e.g. of steel of 160–180 kp/sq.mm tensile strength can be used for stranding the steel core. Consequently, for taking the same mechanical load, considerably smaller steel cross-section is required with the steel-cored aluminium cable according to the invention. The smaller steel-coress-section is advantageous also with respect to the electric losses since the hysteresis loss is lower than in case of the known steel-cored aluminium cables serving for taking the same load. In addition, the specific weight of the steel-cored aluminium cable is considerably lower in case of the invention, since the specific weight of the material of steel core is about three times as great as the specific weight of other parts of the steel-cored aluminium cable, thus it has a definitive significance with respect to the specific weight.

The advantageous circumstance that the aluminium sheet itself forming the coating of the steel core participates also in the electric current conduction, is highly significant with the steel-cored aluminium cable according to the invention. Thus, the resistance loss of steel-cored aluminium cable according to the invention, having an aluminium mantle of given cross-section, is lower than that of the known steel-cored aluminium cables having a mantle of the same cross-section.

As for the corrosion, the solution according to the invention has also considerable advantages, namely the aluminium sheet constituting the coating of the steel core seals off the steel wires of the steel core from the environment and keeps off the detrimental effects of the atmosphere from the steel core. The dust and other solid grains playing a significant role with respect to the life cannot penetrate in between the steel wires of the steel core, due to the aluminium coating on the steel core, used with the steel-cored aluminium cable according to the invention.

An advantageous embodiment of the steel-cored aluminium cable according to the invention is the solution in case of which the space between the steel core and the aluminium coating surrounding it contains anti-corrosive filling. This anti-corrosive filling may be an acid-free vaseline available in various forms in the trade. The purpose of this vaseline is not only to keep off the environmental effects from the steel wires of the steel core, especially the air and vapour being able to penetrate through the possible gaps of the aluminium coating, but it serves as lubricant during the displacement with respect to each other of the wires of steel core during the oscillation of the overhead line and thus practically reduces the internal friction of the steel core.

If necessary, a multi-layer coating may be formed around the steel core. In case of such multi-layer coating, the fitting lines of the ends of the aluminium sheet constituting the coating are shifted along the periphery as compared to each other and as a consequence thereof, the sealing off of the steel core from the environment can be ensured more effectively.

The essence of the steel-cored aluminium cable according to the invention consists thus in that the steel core is provided with a coating made of aluminium sheet.

An expedient embodiment of the steel-cored aluminium cable according to the invention is the solution in which the space between the steel core and its coating contains anti-corrosive filling, expediently acid-free vaseline, whereas in case of another advantageous embodiment the steel core is provided with a coating developed of two or more aluminium sheets engirdling each other.

The steel-cored aluminium cable according to the invention according to the invention will be described in detail by means of the figures of the drawing. In the drawing FIG. 1 indicates the cross-section of an embodiment shown by way of example of the steel-cored aluminium cable according to the invention, FIG. 2 is the line drawing of the top view of an equipment shown by way of example carrying out the process according to the invention.

Figure 2:
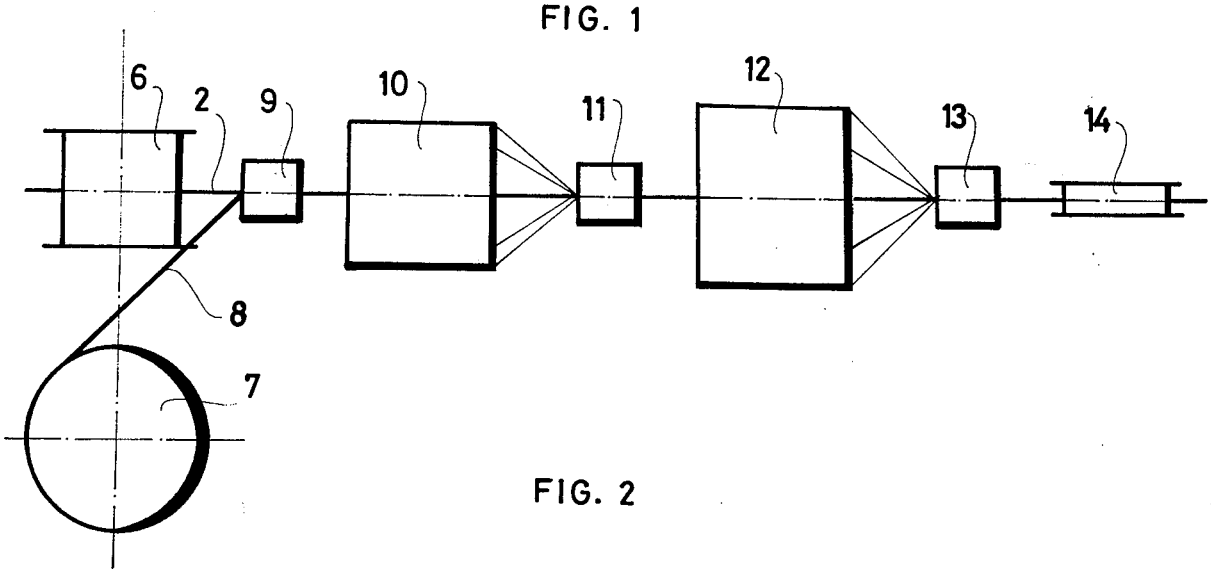

In FIG. 1 a steel-cored aluminium cable is represented in which around the steel core provided with a coating an aluminium mantle consisting of staples is developed in two layers. The coating 3 is bent around the steel core 2 developed of steel wires 1 is pressed onto the steel core 2; the coating 3 is made of aluminium sheet. Inside the coating 3 the space between the steel wires 1 is filled with vaseline 5 which reduces the internal friction, on the one hand, and seals off the space inside the coating 3 from the gases and vapours detrimental with respect to the corrosion.

Around the coating 3 the aluminium mantle developed of staples 4 is arranged which serves for the proper electric conduction. The figure makes evident that due to the so-called upsetting—which was not possible in case of the formerly known steel-cored aluminium cables—the staples 4 have a slightly deformed cross-section and thus, contact each other laterally and radially not along a line but along a relatively large surface and are squeezed to each other along these surfaces. In this way a rather closed cover is formed by the staples.

It may be further seen from FIG. 1 that the inner side of the coating 3 is pressed to a slight extent in between the steel wires 1 and thus, between the coating 3 and the steel core 2 such a close connection develops which provides for a stiffness characterizing the uniform bodies for the coated 3 steel core. The outer side of the coating 3 is also slightly deformed during the upsetting of staples 4 and, as FIG. 1 shows, the protrusions of the coating 3 penetrate in between the staples.

With the equipment illustrated in FIG. 2 the steel cable 2 prepared in advance is wound up to the reel 6 which will be the steel core 2 after the production of the steel-cored aluminium cable. The aluminium sheet 8 is continuously pulled down from the sheet reel 7. The steel cable 2 and the aluminium sheet 8 deflected beside each other come to the drawing stone 9 which forms the aluminium sheet 8 around the steel cable 2 and develops the coating around the steel cable 2 so that it presses simultaneously this coating onto the steel cable. The steel cable provided with a coating comes now into the twisting device 10 where the inner layer of the aluminium mantle consisting of staples 4 is formed in a way known by itself. Thereafter, the cable construction described above comes to the drawing stone 11 which upsets the first layer of the aluminium mantle onto the coating 3.

With the solution shown by way of example, the cable construction already provided with one mantle layer comes to the twisting device 12 where the second layer consisting of staples 4 is developed. Then, the cable is led through the drawing stone 13 which upsets the staples 4 constituting the second layer of the aluminium mantle onto the inner layer. The cable construction is moved through the entire device by means of the extracting disc 14.

The drawing does not contain that part of the equipment or that device which serves for supplying the acid-free vaseline to the steel cable 2. This device may be e.g. a vaseline injecting apparatus, the outflow part of which is directed to the environment of the contacting point of the steel cable 2 and the aluminium sheet 8. The supply of acid-free vaseline to the steel cable 2 may be ensured in such a way, too, that before contacting the aluminium sheet 8, the steel cable is led through a tank containing vaseline of suitable consistence. In such cases the steel cable carries with a certain vaseline quantity adhered to its surface, which later on, at the development of the coating 3 and at the pressing of the coating to the steel cable, is pressed and dissipated in between the steel wires 1.

The advantage of the steel-cored aluminium cable according to the invention consists in that for taking an unchanged mechanical load, a smaller steel cross-section is required since high-strength steel can be used. The smaller steel cross-section considerably reduces the specific weight of the steel cable and the nominal diameter of the complete cable. As a result of the smaller steel cross-section, that component of the electric loss which is constituted by the hysteresis loss of the steel, will reduce.

The coating itself developed around the steel core participates in the conduction of the electric current. Consequently, the steel-cored aluminium cable developed according to the invention causes a lower resistance loss in case of a mantle of unchanged cross section, or conversely, the case may be that for the conduction of an unchanged current intensity, a mantle of smaller cross-section may be used with the cable according to the invention. By way of this latter circumstance the nominal diameter of the cable can be further reduced.

With the cable according to the invention it is possible to upset the mantle consisting of aluminium staples to the steel core. Such an upsetting renders the space utilization of the cable more advantageous and lastly it results in the reduction of the nominal diameter. The above mentioned upsetting is advantageous even because the staples consisting the mantle are deformed to a closed cover and this is advantageous with respect to the reduction of corrosion.

The aluminium coating developed around the steel core results in the complete sealing off of the steel core from the environment. Therefore, the corrosion effects also considerably reduce, that is the steel-cored aluminium cable according to the invention has a much longer life than the known cables. Since the aluminium coating excludes the possibility of dust and other solid contaminations getting onto the steel core, their abrasive effect falls also out, whereby again the life is increased. The same effect is displayed by the vaseline which, in addition thereto, serves as lubricant and reduces the internal friction of the steel.

Finally, it should be noted that—as it became obvious from the foregoings—in case of the cable according to the invention the reduction of the nominal diameter becomes possible from several points of view. This fact involves that is case of overhead lines the assembly units used for hanging up the cable and for other purposes have also smaller dimensions and lighter weight, intensifying thus the result achieved by the invention.

What we claim is:

1. A steel-cored aluminum cable for electric power conduction, comprising a steel core including a plurality of steel wires, an aluminium coating disposed all around the wires and formed from an aluminium sheet having an inner surface pressed into direct contact therewith and a substantially cylindrical outer surface and a plurality of aluminium staples disposed around the aluminium coating ans upset into direct contact with the cylindrical outer surface of the aluminium coating along the entire innermost circumferential surface of the aluminium staples to impart a trapezoidal cross-section to each of the staples.

2. The steel-cored aluminium cable according to claim 1, wherein any space between the steel core and the coating contains anti-corrosive filling.

3. The steel-cored aluminium cable according to claim 2, wherein the filling is acid free vaseline.

4. The steel-cored aluminium cable according to claim 1, wherein the coating is formed at least two aluminium sheets engirdling each other on the steel core.

5. Process for producing the steel-cored aluminium cable according to claim 1, characterized in that beside the seel cable (2) aluminium sheet (8) is deflected, then during their forwarding together, the aluminium sheet (8) is continuously bent around the steel cable (2) and pressed onto the steel cable (2), and thereafter, the aluminium mantle is stranded onto the coating (3) made of aluminium sheet.

6. Process according to claim 5, characterized in that before the contacting the aluminium sheet (8), an anti-corrosive substance, expediently acid-free vaseline (5) is supplied to the steel cable (2).

7. Process according to claim 5 or 6, characterized in that the steel cable (2), together with the aluminium sheet (8), being led through a drawing stone (9), the aluminium sheet (8) is bent and pressed onto the steel cable (2).

8. Process according to claim 5 or 6, characterized in that the aluminium sheet (8) is bent and pressed onto the steel cable (2) by means of rolls.

9. Process according to claim 5, characterized in that during the bending and pressing of the aluminium sheet (8) onto the steel cable (2) a load generating a stress belonging to, or higher than the yield point of the material of the aluminium sheet (8) is exerted onto the aluminium sheet (8).

10. Process according to claim 5, characterized in that the aluminium mantle is upsetted onto the steel core (2) provided with coating (3) expediently by leading it through a drawing stone (11, 13).

* * * * *